United States Patent [19]

Lacy

[11] Patent Number: 4,926,782

[45] Date of Patent: May 22, 1990

[54] ADJUSTABLE WINDSHIELD AND CANOPY FOR A BOAT

[76] Inventor: Franklin R. Lacy, 12819 SE. 38th, Suite 57, Bellevue, Wash. 98006

[21] Appl. No.: 236,596

[22] Filed: Aug. 26, 1988

[51] Int. Cl.[5] ..... B63B 19/02

[52] U.S. Cl. ..... 114/361

[58] Field of Search ..... 114/343, 361; 135/88, 135/95, 107; 296/84.1, 156

[56] References Cited

U.S. PATENT DOCUMENTS

| | | | |
|---|---|---|---|
| 3,021,535 | 2/1962 | Dorst | 114/361 |
| 3,290,706 | 12/1966 | Hale | 114/361 |
| 3,304,657 | 2/1967 | Singleton | 114/361 |
| 3,312,990 | 4/1967 | Lapworth | 114/361 |
| 3,320,698 | 5/1967 | Hummel | 114/361 |
| 3,336,612 | 8/1967 | Stevens | 114/361 |

*Primary Examiner*—Joseph F. Peters, Jr.

*Assistant Examiner*—Edwin L. Swinehart

*Attorney, Agent, or Firm*—Graybeal, Jensen & Puntigam

[57] ABSTRACT

A flat single piece windshield (10) which extends across the bow of the boat and is rotatably connected thereto by hinges (20,22). The windshield (10) includes two elongated support elements (48,50) which extend, respectively, from the top edge (14) of the windshield (10) downwardly to tracks which extend respectively along the gunwales of the boat. The lower ends of the support elements (48,50) are movable along the longitudinal tracks, thereby providing a capability for the windshield (10) to be raised and lowered through a large angle relative to the plane of the boat. A canopy (11) which includes a frame (67) and a cover (124) extends rearwardly from the top edge (14) of the windshield (10). The canopy (b 11) is supported by telescoping poles (82,84) which extend from the rear of the canopy (11) downwardly to the gunwales of the boat.

13 Claims, 6 Drawing Sheets

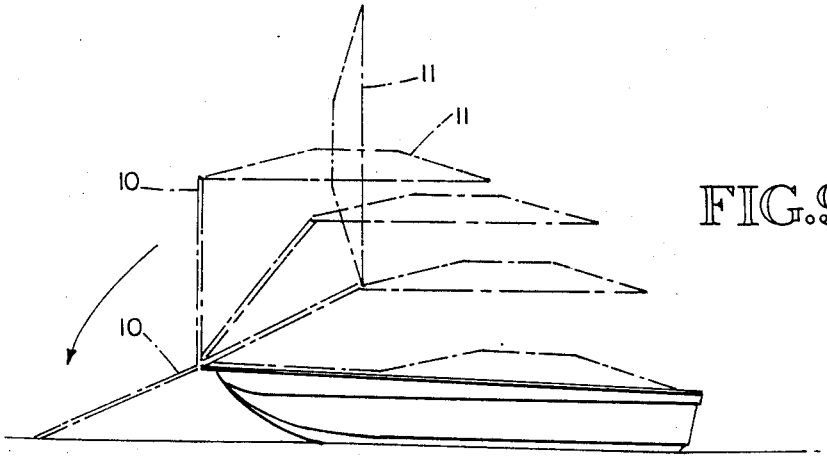
FIG.9
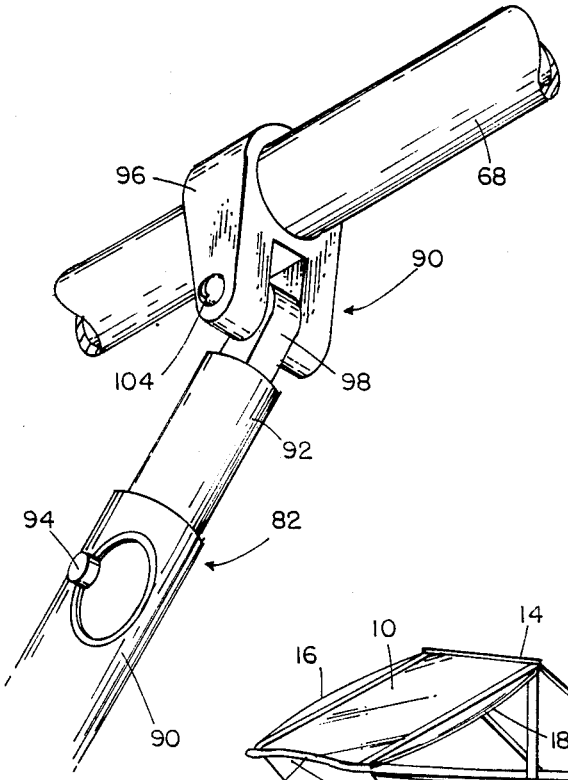
FIG.8
FIG.10
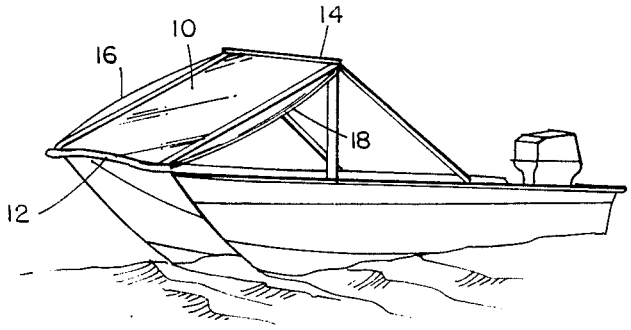

ADJUSTABLE WINDSHIELD AND CANOPY FOR A BOAT

DESCRIPTION

1. Technical Field

The present invention relates generally to windshields and associated top covers (canopies) for boats, and more specifically concerns a boat windshield and top cover combination which is adjustable to various positions.

2. Background of the Invention

Typically, boat windshields, particularly for small boats, comprise two pieces of clear plastic or glass, are relatively small and are typically fixed in position on the boat. Such windshields typically perform but a single function. Boat accessories such as bow ramps, air trim tabs and the like have heretofore been completely separate from the boat windshield. Such articles, as well as others, are often not used with such boats because they are impractical or too expensive.

Further, the concept of a fixed position, small windshield has limited the use of top covers, i.e. canopies, for small boats. A canopy is typically fixed in position and includes a substantial amount of supporting elements. They are often inconvenient to adjust even when they are alleged to be adjustable and are inconvenient to disassemble and stow when not in use. In many cases, for such reasons and others, canopies are often not used with small boats.

DISCLOSURE OF THE INVENTION

The present invention is a relatively large, single piece windshield element which is pivotally secured to the boat in the vicinity of the bow thereof, depending on the configuration of the hull of the boat. The windshield is supported by two elongated support elements extending between the windshield element and the boat itself. In one embodiment, the support elements extend to the gunwales of the boat. This arrangement permits the windshield to be fixed in any position ranging from a flat position against the gunwales of the boat through an angle greater than 180° forwardly of the bow of the boat.

A top cover (canopy) is removably secured to, and extends to the rear from, the top edge of the windshield, and is supported relative to the boat in such a manner that it is raised and lowered with the raising and lowering of the windshield.

BRIEF DESCRIPTION OF THE DRAWINGS

FIG. 8 is an elevational view showing another portion of the canopy frame of the present invention, in particular the telescoping rear leg thereof.

FIG. 9 is a side elevational view showing in simplified form several of the positions of the windshield and/or the windshield/canopy combination of the present invention.

FIG. 10 is an isometric view showing the windshield of the present invention in a partially raised, runabout position.

BEST MODE FOR CARRYING OUT THE INVENTION

Figure 1:
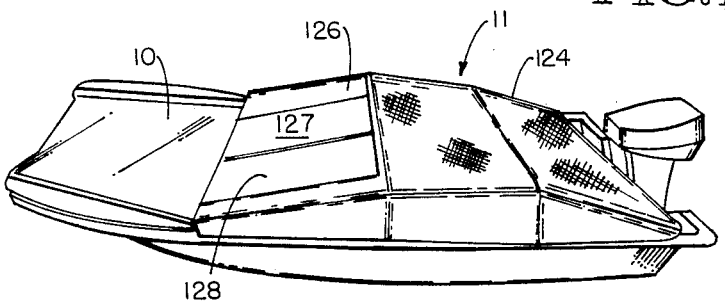
FIG. 1 is an isometric view showing the windshield and canopy combination of the present invention in a lowered position.

FIGS. 2, 3, 5, 10 and 11 show most clearly the boat windshield of the present invention. In the embodiment shown, the windshield, shown generally at 10, is a single piece of scratch resistant, heavy duty plastic, such as Lexan, from Dupont. Other materials, however, could be used. The front bottom edge 12 of the windshield extends substantially across the entire bow of the boat, and is configured to mate with the configuration of the front edge of the bow of the boat, depending upon the hull configuration of the boat. The windshield 10 extends rearwardly for a substantial portion of the total length of the boat when it is in its lowered position against the gunwales of the boat. As an example, for a boat which is 14 feet long, the windshield 10 is typically 5 feet long. The top edge 14 of windshield 10 is typically straight. The side edges 16 and 18 respectively, connect the front and top edges 12, 14 and are configured to mate with the gunwales of the forward portion of the boat, so that when the windshield is in its lowered position, the side edges 16 and 18 mate with the corresponding portion of the gunwales.

Figure 5:
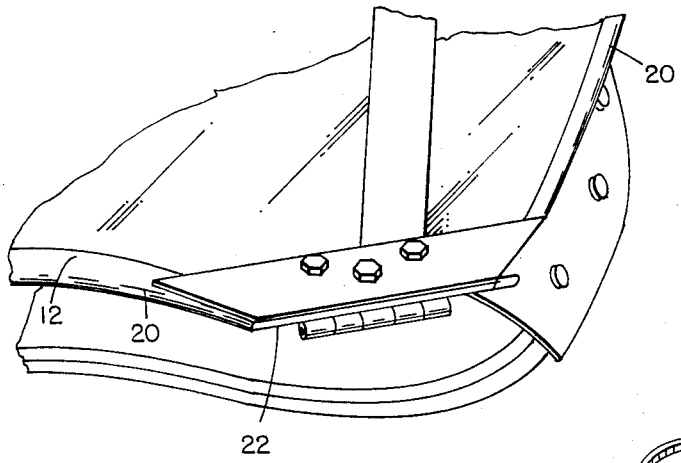
FIG. 5 is an elevational view showing a portion of the windshield pivotally connected to the bow of the boat.

In the embodiment shown, the exposed edges of the windshield 10 are covered with a vinyl windshield trim 20 (FIG. 5). The windshield 10 is connected to the bow of a two hull boat at the respective corners thereof by two heavy duty hinge elements 20 and 22. For single hull boats with a single pointed bow, the hinge connections would be moved rearwardly sufficiently to maintain the required support. The hinge elements 20 and 22 are arranged so that the windshield 10 may be pivoted from a fully lowered position adjacent the gunwales of the boat through a continuous angle to a position which extends forwardly of the boat and slightly downwardly therefrom, as shown in FIG. 9. The windshield 10 may also be supported in any position between the two extremes. In an alternative embodiment, the hinges 20,22 are movable forwardly and downwardly to a point beneath the water, enabling the windshield to be used as a viewing window.

Figure 11:
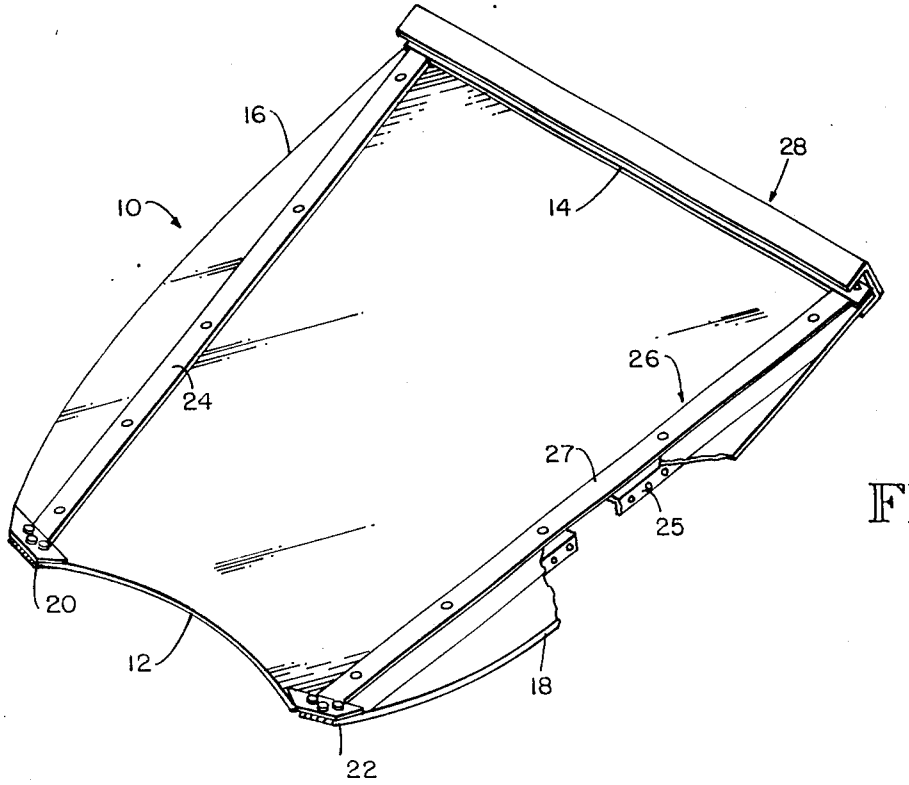
FIG. 11 is an isometric view of the windshield and the frame thereof of the present invention.

A windshield support frame extends rearwardly from the hinge 20 and 22 for support of the windshield, as shown most clearly in FIG. 11. The support frame comprises three sections, including two side sections 24 and 26 which extend from the hinges 20 and 22, respectively, to the top edge 14 of the windshield. Rear section 28 connects the side sections 24 and 26 across the top edge of the windshield. Side sections 24 and 26 each comprise a length of aluminum "L" channel 25 which is positioned underneath the windshield 10, and a flat, narrow length of aluminum plate 27 positioned above the windshield 10. These two elements 25 and 27 are riveted together, capturing the windshield 10 between them. In the embodiment shown, the two side sections 25, 27 are made from ⅛ inch aluminum.

Figure 4:
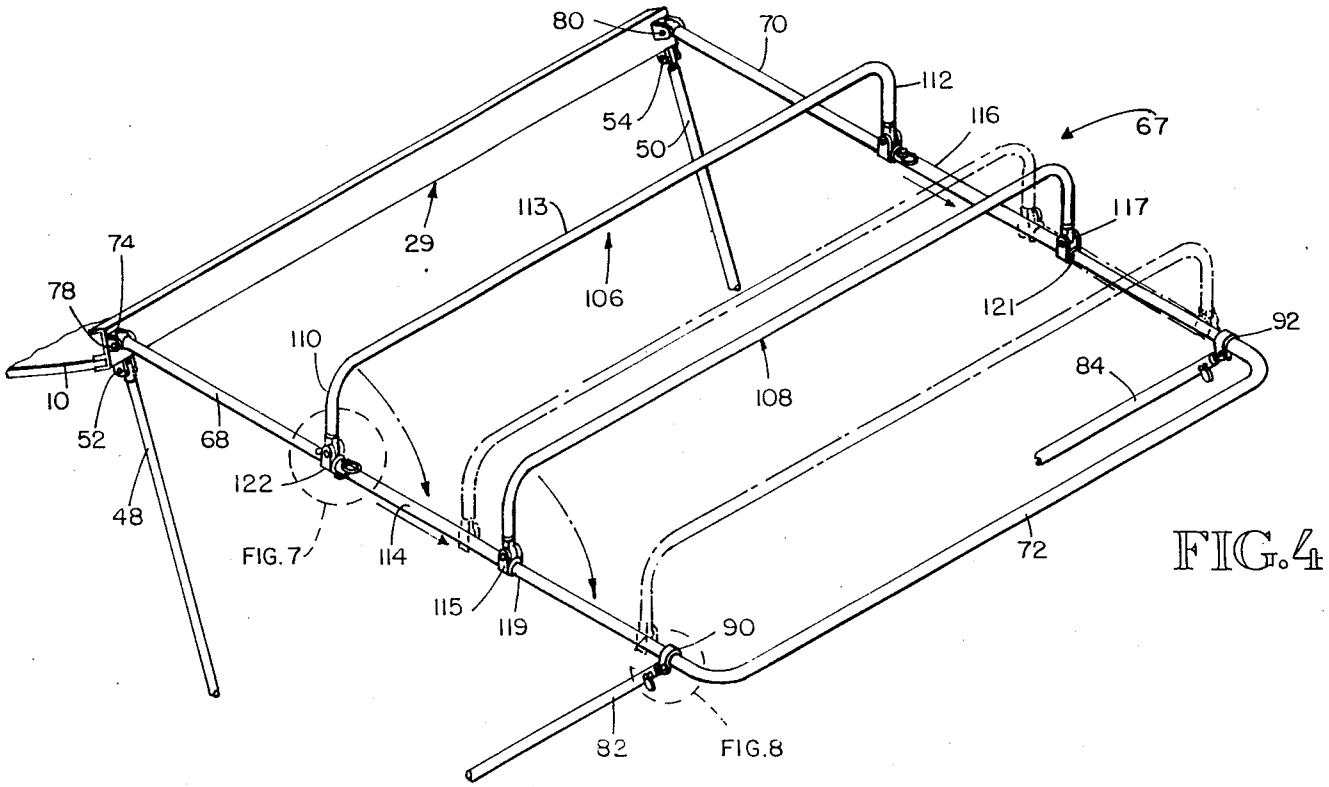
FIG. 4 is an isometric view showing the frame for the canopy portion of the present invention.
Figure 6:
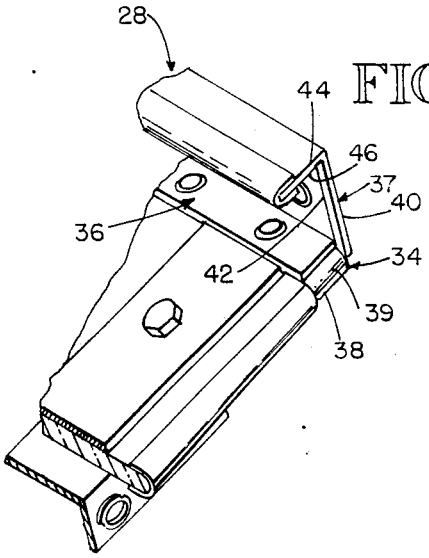
FIG. 6 is an isometric view showing a portion of the top edge and adjacent side of the windshield of the present invention.
Figure 7:
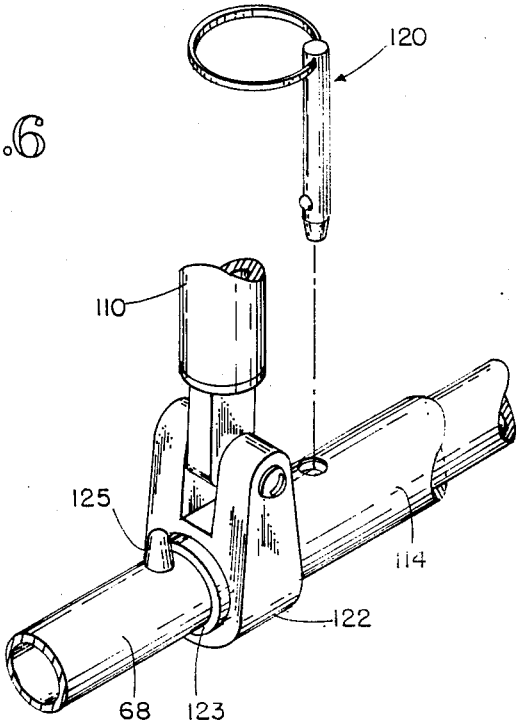
FIG. 7 is an elevational view showing a portion of the frame of the canopy of the present invention.

The rear frame section 28 is shown specifically in FIGS. 4, 6 and 11. Rear frame section 28 comprises three elements 34, 36 and 37. One rear frame element 34 is in the form of an L-shaped section, while element 36 is a narrow flat plate. Rear edge portion 39 of the windshield 10 is sandwiched between a leg portion 38 of L-shaped element 34 and the flat plate 36 and riveted together, thereby providing a stable connection between the rear frame section 28 and the windshield 10. Element 37 is another L-shaped section, arranged so that the long portion 40 of L-shaped section 37 lies adjacent the back of the long portion 42 of L-shaped section 34, with the short portion 44 of L-shaped section 37 extending forwardly a short distance above the plate 36. The two L-shaped sections 34, 37 are riveted together along their long portions. On surface 46 of short portion 44 of L-shaped section 37 are provided a plurality of snaps to which the top cover may be secured.

Extending downwardly from the rear frame section 28, in the vicinity of each end thereof, are two elongated support poles 48 and 50. In the embodiment shown, the support poles 48, 50 are ½ inch aluminum tubing, and approximately 96 inches long. Support poles 48 and 50 are rotatably connected at their upper ends to the rear frame section 28 at connections 52 and 54 by screws or the like.

Figure 12:
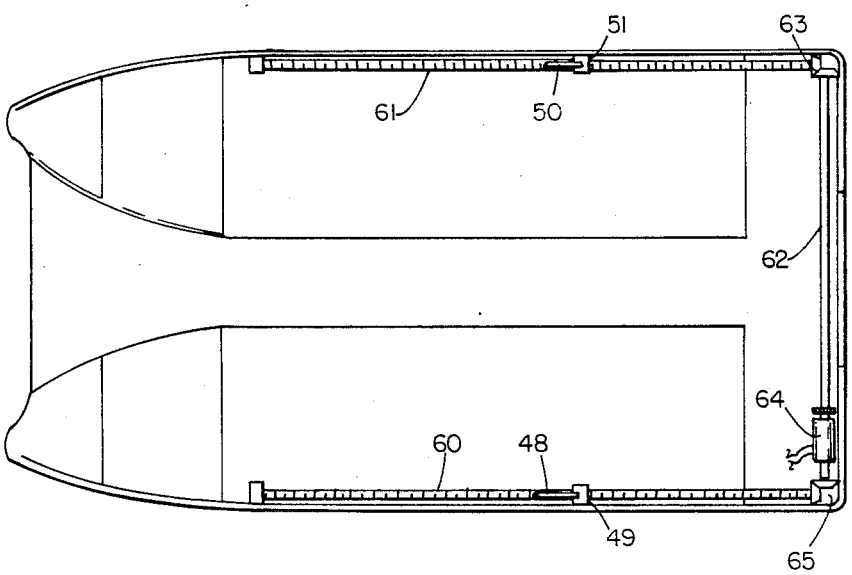
FIG. 12 is a top view of a boat showing the means for raising and lowering the windshield of the present invention

Support poles 48 and 50 are connected, respectively, at their lower ends 49,51, to elongated tracks (FIG. 12) which extend longitudinally of the boat along each side thereof, slightly below or at the gunwales of the boat. In the embodiment shown, side worm gears 60,61 in the tracks move the ends 49 and 51 of the support poles along the tracks. At the rear of the boat in the embodiment shown is a driveshaft 62 which is connected by bevel gears 63,65 to the two longitudinal worm gears 60,61. The driveshaft 62 is controlled by a motor 64. Thus, the lower ends 49,51 of the support poles 48 and 50 move longitudinally of the boat in unison by action of worm gears 60 and 61, which results in a change of position of the windshield.

Alternatively, a chain drive can be used instead of the driveshaft 62 or support poles 48, 50 can be connected to the boat by locking pins or the like in detentes located at spaced positions along the longitudinal dimension of the boat, either along the sides or bottom of the boat.

In the embodiment shown, the support pole/worm gear arrangement is such that the windshield 10 is capable of moving under positive control from a completely lowered position adjacent the gunwales of the boat through an angle of 180° and even greater so that the windshield 10 extends beyond the bow of the boat and downwardly relative to the longitudinal plane of the boat. In all positions, however, the windshield 10 is supported by the hinge elements 20 and 22 and the support poles 48 and 50.

FIGS. 1–3, 4, 7, 8 and 9 show the canopy portion 11 of the combination windshield/canopy of the present invention. The canopy 11 includes a frame 67 which is shown most clearly in FIG. 4. The frame 67 comprises side tube elements 68 and 70 which extend rearwardly of the boat from the opposite ends of rear frame section 28 of the windshield support frame. The side tube elements 68 and 70 are connected by a rear tube element 72. In the embodiment shown, for a 14 foot boat, with a 5 foot windshield, the length of side tube elements 68, 70 are approximately 8 feet and the canopy as a whole is approximately 8.5 feet. The side tube elements 68 and 70 are rotatably and removably connected at connections 74 and 76 to the rear frame section 28 of the windshield support frame. Pin elements 78 and 80 may be conveniently removed to permit removal of the side tube elements 68 and 70.

Figure 2:
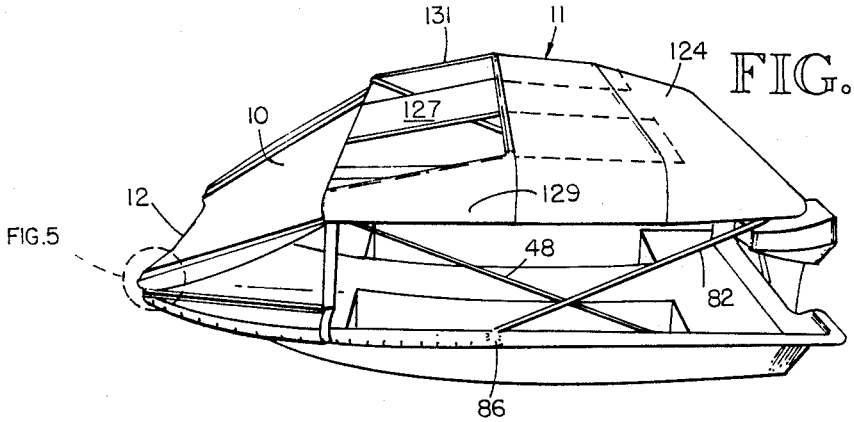
FIG. 2 is an isometric view showing the windshield and canopy combination of FIG. 1 in a partially raised position.
Figure 3:
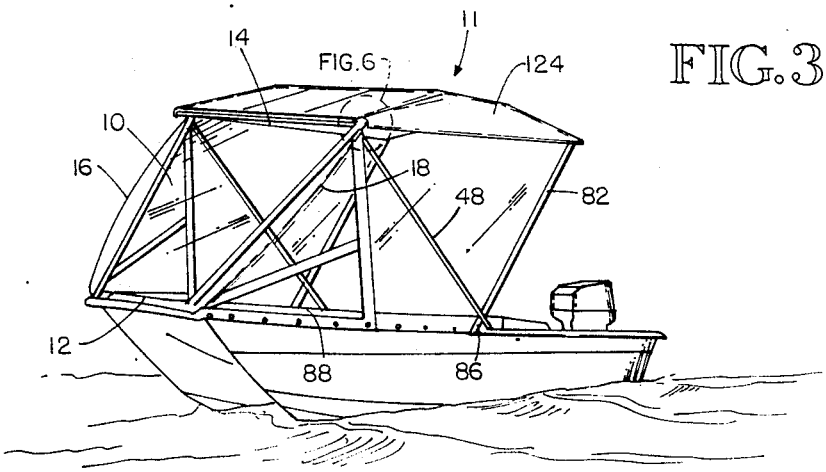
FIG. 3 is an isometric view showing the windshield and canopy combination of FIG. 1 in a more fully raised position.

Extending downwardly from the vicinity of the rear end of the side tube elements 68 and 70 are two side support poles 82 and 84. The poles 82 and 84 are rotatably connected to side tube elements 68 and 70 at connections 90 and 92, respectively. Side support poles 82 and 84 in the embodiment shown are arranged to telescope, and extend at an angle downwardly to pivotable connection points 86 and 88 along the gunwales of the boat (FIGS. 2 and 3). The poles 82, 84 are connected by pins (not shown) or the like to connection points 86, 88, permitting quick disconnection thereof. Connection points 86 and 88 are fixed relative to the longitudinal dimension of the boat.

FIG. 8 shows in detail the telescoping nature of side support poles 82 and 84. Each telescoping pole, i.e. pole 82, comprises two concentric pole elements 90 and 92. Each pole element has a plurality of spaced openings therein (not shown). A ringed pin 94 is selectively positioned through openings which are in registry in the pole elements 90 and 92 to provide the telescoping capability for the pole. The connection 90, for example, includes a bracket 96 which depends from side tube element 68. Mating with the bracket 96 is an ear-like element 98 which extends upwardly from the top end of pole element 92. The ear-like element 98 is rotatably connected to the bracket 96 by a pin or screw 104. The entire side support pole 82 may thus be easily disconnected from the side tube element 68 by removal of pin 104.

Referring again to FIG. 4, the frame 67 of the canopy 11 includes two top support elements 106 and 108, both in the form of shallow, U-shaped elements, extending between side tube elements 68,70, and typically comprising ½ inch aluminum tubing. In the embodiment shown, the top support elements 106, 108 are each approximately 65 inches long, i.e. the length of the horizontal middle portion 113, while the vertical leg portions 110 and 112 at each end of the middle portion 113 are approximately 6 inches long.

The top support elements 106 and 108 are each pivotally and removably connected at each end thereof to opposing sections of tubing 114 and 116 which have a slightly larger internal diameter than the exterior diameter of side tube elements 68 and 70. Sections 114 and 116 thus are capable of sliding along side tube elements 68 and 70. The pivoting connections 115 and 117 which connect top support element 108 to tubing sections 114 and 116 are fixedly connected to the rear ends 119, 121, respectively, thereof. Similar pivoting connections 122, 124 for top support element 116, however, are slidable along tubing sections 114 and 116. Connections 122, 124 are held in position near the front ends of tubing sections 114 and 116 by a ring and pin element 120. Element 120 also holds the tubing sections in place, as shown most clearly in FIG. 7. A rounded extension 125 is located on the surface of side tube element 68 adjacent the front end 123 of tubing section 114. This prevents tubing section 114 and bracket 122 from sliding forward. A similar structure is present for tubing section 116.

When pin 120 is removed, section 114 may be slid to the rear of the frame 67 and connection 122 may be slid to the rear of section 114, adjacent top support element 108. In this position, the two top support elements 108 and 106 are at the very rear of the frame 67. Further, the two top support elements can be pivoted downwardly and to the rear, thereby bringing elements 108 and 106 substantially adjacent rear section 72.

The frame 67 supports a cloth cover shown generally at 124 (FIGS. 1, 2, 3) which is secured to side tube elements of the frame and supported by the top support elements thereof. The cover 124, in the area between the top edge of the windshield 10 and top support element 106, is divided into three sections 126, 127, 128 which are secured to each other along their respective side edges by zippers or the like. The front edge of each section is secured to the rear frame section 28 of the windshield frame by snaps or the like. In the embodiment shown the sections 126–128 are equal in dimensions. They can be individually removed, or tucked rearwardly under the remaining cover, as shown in FIG. 2, to provide different shading effects, as desired. In addition, side cover sections 129, 131 can be removed as well.

FIG. 1 shows the windshield and cover combination in a fully stowed position. In the fully stowed position, the windshield 10 lies flat against the gunwales of the boat, as does the frame and cover of the canopy. The longitudinal edges of the cover can be attached via snaps or the like to the gunwales of the boat. Top support members 106 and 108 can be pivoted so that they are substantially parallel to the gunwales of the boat.

FIG. 2 shows the windshield and cover in a partially raised position. To move the structure to this position, it is simply necessary to move the support poles 48 and 50 of the windshield somewhat forwardly. This action raises the windshield and raises the canopy as well. In this position, the windshield 10 is at an angle of approximately 30° relative to the plane of the gunwales. This is a good runabout position, and provides a good "air trim" capability for the boat. The actual airflow over the bow can be easily adjusted by changing the angle of the windshield.

FIG. 10 shows the windshield in such a position without the canopy. This position of the windshield tends to force the bow of the boat downward so that the boat will "plane", i.e. skim over the top of the water, at a lower speed then otherwise, thereby increasing safety and maneuverability and economy of operation.

FIG. 3 shows a further raised position of the windshield 10 in which the support poles 48 and 50 have been moved further forward than shown in FIG. 2. In this position, the windshield is at an angle of approximately 60° relative to the plane of the gunwales. This position of the windshield provides full utilization of the area of the boat, with up to 7 feet of head room while providing protection from inclement weather.

FIG. 9 shows further positions of the combination of the windshield 10 and the canopy 11. In one position, note that the windshield 10 is substantially vertical and the canopy 11 is substantially horizontal, providing an awning-like effect for the boat. The canopy awning can then be moved upwardly from the horizontal by means of the telescoping support poles. In one such position, the canopy 11 is positioned vertically so that it acts like a sail.

The canopy 11 can be removed from the windshield 10 by disconnecting the pins in the two pivot connections at the top edge 14 of the windshield. This permits the windshield to be rotated further forward, either into a lounge position, which is approximately 120° relative to the plane of the boat, or beyond 180° so that it acts as a bow ramp, or as a fish viewing window. This also permits the frame of the canopy to rest on the gunwales of the boat with the cloth top gathered fully rearward to provide maximum room within the boat.

Accordingly, a combined single piece windshield and canopy arrangement for a boat has been described which is position-adjustable and which thereby provides a great number of operational advantages. It should be understood that the windshield can be used either alone, or in combination with the canopy, each of which individually has several significant advantages.

Although a preferred embodiment of the invention has been disclosed herein for illustration, it should be understood that various changes, modifications and substitutions may be incorporated in such embodiments without departing from the spirit of the invention as defined by the claims which follow.

I claim:

1. An adjustable windshield, adapted for use with a boat having a deck, a bow, a stern, and gunwales, the windshield comprising:

a windshield element, having bottom and top edges, which is sufficiently wide to extend substantially across the bow of the boat;

means movably and directly connecting the bottom edge of the windshield element to the deck of the boat in the vicinity of the bow thereof, such that the windshield element moves about the connecting means at the deck of the boat between a first stowed position adjacent the gunwales aft of the connecting means, and a second position angularly removed from the first position;

elongated support means movably connected at one end thereof to the windshield element; and means connecting the other end of the elongated support means to the boat in such a manner that the said other end is capable of moving longitudinally of the boat a selected distance so that the windshield element may be raised and lowered about the connecting means accordingly.

2. An apparatus of claim 1, including a frame for supporting said windshield element.

3. An apparatus of claim 1, wherein the other end of the elongated support means is connected to the boat in the vicinity of the gunwales thereof and is movable therealong.

4. An apparatus of claim 1, wherein the said windshield element is configured so that it matches the outline of the gunwales of the boat when said windshield element is lowered to the stowed position against the gunwales.

5. An apparatus of claim 3, wherein said windshield element has a length which is greater than ⅓ of the length of the boat.

6. An apparatus of claim 1, wherein said elongated support means comprises two support poles positioned at opposite sides of said windshield element in the vicinity of the top edge thereof.

7. An apparatus of claim 6, wherein said connecting means includes a motor and connecting gears for controllably moving the other end of said support poles simultaneously along the gunwales of the boat.

8. An apparatus of claim 1, wherein the windshield element is flat and comprises one piece of material.

9. An apparatus of claim 1, wherein said means movably connecting the bottom edge of the windshield element to the bow of the boat includes at least one hinge which is arranged to permit a greater than 180° range of movement.

10. An apparatus of claim 1, including a canopy system which includes a frame having a forward end and an opposing rear end, said frame extending rearwardly to the rear end from the top edge of the windshield, said frame being removably and rotatably connected to the top edge of the windshield, said frame further including support pole elements which extend from the vicinity of the rear end of said frame downwardly to the gunwales of the boat, wherein said canopy includes a cover element which extends over said frame.

11. An apparatus of claim 10 wherein said support pole elements are telescoping and extend to a connection element on the gunwales of the boat which is fixed longitudinally but permits rotation of the support pole elements.

12. An apparatus of claim 10, wherein portions of the cover are arranged to be selectively removable.

13. An apparatus of claim 10, wherein said frame includes opposing side members, a connecting rear member and at least two top members extending between said side members, and further includes two support members positioned on the side members and slidable therealong, the support members including means for mounting the two top members, wherein the mounting means for the frontmost top member is movable along the support members, such that the top members are capable of being positioned adjacent the connecting rear member.

* * * * *